United States Patent [19]

Schmidt-Hatting

[11] 4,326,939

[45] Apr. 27, 1982

[54] ANODE SUPPORT SYSTEM FOR A MOLTEN SALT ELECTROLYTIC CELL

[75] Inventor: Wolfgang Schmidt-Hatting, Rüti/ZH, Switzerland

[73] Assignee: Swiss Aluminium Ltd., Chippis, Switzerland

[21] Appl. No.: 208,697

[22] Filed: Nov. 20, 1980

[30] Foreign Application Priority Data

Dec. 3, 1979 [CH] Switzerland ..... 10704/79
Sep. 12, 1980 [CH] Switzerland ..... 6865/80

[51] Int. Cl.[3] ..... C25C 7/02; C25C 3/12; C25C 3/16

[52] U.S. Cl. ..... 204/228; 204/243 M; 204/286; 204/244

[58] Field of Search ..... 204/228, 286, 243 R, 204/243 M, 244, 245-247, 60, 297 R

[56] References Cited

U.S. PATENT DOCUMENTS 1,265,551 5/1918 Thomson ..... 204/228
3,417,008 12/1968 Koltuniak ..... 204/228 X
3,634,224 1/1972 Garab et al. ..... 204/243 R X

*Primary Examiner*—Delbert E. Gantz
*Assistant Examiner*—Donald R. Valentine
*Attorney, Agent, or Firm*—Bachman and LaPointe

[57] ABSTRACT

The present invention relates to an anode support system for supplying electric current to a molten salt electrolytic cell wherein a pronounced reduction or suppression of the metal wave in the cell can be achieved without increasing the interpolar distance between the metal wave and the above lying anode.

The anode support system, which may comprise two horizontal anode beams which are joined together at the ends by conductor plates, is separated at least at two places and joined up again in a mechanically stable manner by means of an electrically insulating material. If the anode support system is made of a single piece then it is separated at least at one place over its whole cross section and joined up again by an insulating joint.

The electrically insulated sites can be bridged in parallel by switches.

8 Claims, 5 Drawing Figures

ANODE SUPPORT SYSTEM FOR A MOLTEN SALT ELECTROLYTIC CELL

BACKGROUND OF THE INVENTION

The present invention relates to an anode support system for supplying electric current to a molten salt electrolytic cell and in particular a cell used for producing aluminum.

Aluminum is produced electrolytically from aluminum oxide by dissolving the aluminum oxide in a fluoride melt which is made up for the most part of cryolite. The cathodically deposited aluminum collects under the fluoride melt on the carbon floor of the cell where the surface of the liquid aluminum serves as the cathode. Dipping into the melt are anodes which are secured from above on anode beams. In conventional processes the anodes are made of carbon. As a result of the electrolytic decomposition of the aluminum oxide, oxygen is formed at the carbon anodes and reacts with the carbon to form CO and $CO_2$. The electrolytic process generally takes place at a temperature of 940°-970° C. In the course of this process the electrolyte is depleted of aluminum oxide. At a concentration in the electrolyte of 1-2 wt.% aluminum oxide the so-called anode effect occurs which results in a stepwise voltage increase from, for example, 4-4.5 V to 30 V and more. At this time at the latest the solid crust of electrolyte formed on the cell must be broken open and the aluminum oxide concentration increased by adding new aluminum oxide (alumina).

Under normal operating conditions the crust on electrolytic cell is usually broken open and fresh alumina fed to the cell at regular intervals even if no anode effect has occurred.

On increasing the current supplied to the cell to a value of 50 kA (kilo ampere) harmful magnetic effects are observed namely a greater upward doming or streaming of the liquid metal in the cell occurs. The reasons for these effects are described in detail in the relevant technical literature, and have led to numerous suggestions of ways to avoid them. The disadvantages arising from the doming and streaming of the metal has also been the subject of many articles.

Both of the above mentioned magnetic effects are however to be differentiated from a further magnetic effect namely the moving wave of metal. This wave of metal runs, depending on the general direction of current flow in the pot line hall, either clockwise or counter-clockwise along the ledge of the cell.

All three magnetic phenomena discussed above have the same root cause namely they are due to an unfavorable distribution of current densities and magnetic induction in the melt.

Publications have been made describing related theories for the doming and streaming of the liquid aluminum. No satisfactory explanation has, however, yet been provided relating current density and induction on the one hand and the creation, persistence and propagation of the metal wave on the other hand. In spite of this, the metal wave rotating right or left, generally along the edge of the bath can be detected, described and followed in the cell.

Wherever the wave is in the cell at any given moment the interpolar distance to the above lying anode becomes smaller. Along with this reduction in the interpolar distance, the resistance in the electrolyte to the direct electric current is also reduced, thereby causing a momentary rise in current at the peak of the wave. As the sum of the currents from all anodes at any given moment corresponds to the direct current value of the cell, the levels of current outwith the region of the metal wave are reduced, in accordance with the interpolar distance, until the wave in the metal has moved further.

The moving wave leads to a change in current level in the individual anodes which varies in time in a sine-wave-like function, whereby however the level of direct current in the anode rod remains constant. The time the wave takes to pass round the cell i.e. the time until it returns to the same anode rod is usually between 30 and 80 seconds.

The reduction in the interpolar distance by the moving wave in the metal brings liquid aluminum, which has already been produced in the process, near the gaseous $CO_2$ which is formed at the carbon anode. This causes some of the aluminum to be reoxidized to $Al_2O_3$, resulting in a lower yield from the cell and correspondingly a lower current efficiency.

One counter-measure here is to increase the interpolar distance at all anodes. This usually reduces the height of the wave and can often even eliminate it altogether. By increasing the interpolar distance, however, the ohmic voltage drop in the electrolyte is raised, and consequently the amount of electrical energy which is consumed is converted to heat instead of producing aluminum. As a result of the lower metal yield the aluminum produced in each unit becomes much more expensive. By simultaneously measuring the current in all the anode rods, by means of standard measuring methods, the position of the metal wave can be readily determined and its movement followed.

The height of the metal wave is some millimeters to some centimeters. In extreme cases it can even cause momentary short circuiting between the cathode and the anode as the interpolar distance is of the same order of magnitude, usually between 4 and 6 cm.

On increasing the interpolar distance both the amplitude of the metal wave and that of the alternating current in the anode rod current decrease. From numerous measurements and observations it has been deduced that the resultant alternating current is due solely to the wave in the metal. Once the wave has been created, as is always the case, the alternating current is responsible for maintaining and propagating the wave.

It is therefore a principal object of the present invention to provide a cell for the electrolysis of fused salts wherein the metal wave is markedly reduced or suppressed without increasing the interpolar distance between the metal wave and the above lying anode.

SUMMARY OF THE INVENTION

The foregoing object is achieved by way of the present invention wherein anode support system, comprising at least two horizontal anode beams and conductor plates joining them together at the ends, is separated completely at least at two places but joined in a mechanically stable manner with electrically insulating material, whereby (a) an electrical connection of parts of the same beam of the anode support system is made only via the previous cell, (b) the electrically insulating divisions are, with due regard to the busbar arrangement from one cell to another, such that the anode rods secured to the individual parts of the anode support system can draw their normal current from the fractions of the total currents supplied to these parts of the system, (c) anode beams or support plates each feature at most one electrically insulating division when the current is fed to the ends of the anode support system.

Measurements have shown that the alternating current which maintains the metal wave and sets it rotating flows only in the anodic part of the cell.

The circuit for the alternating current can be described as follows. This current flows downwards in one or a few anode rods, passes through the corresponding anode, leaves it at the bottom, passes through the electrolyte more or less vertically and enters the metal below. In the metal the alternating current flows horizontally to the approximately diametrically opposite anodes at the edge of the cell, leaves the metal there, flows through the electrolyte approximately vertically upwards, enters the above lying anodes, passes through these, through the anode rods into the anode beam and returns to the anode rods mentioned at the start. This current loop rotates to the left or right, depending on the position of the return current in the pot room, about a vertical axis which is situated approximately in the center of the pot room, while the metal wave—and with it—the alternating current maximum at the periphery of the cell. With the division of the anode beam system according to the invention the above mentioned alternating current circuit is interrupted electrically, as a result of which metal waves are no longer possible as the driving, alternating current is for the greater part absent.

In the course of the electrolytic process, however, when there is a distorted cathodic current distribution, disturbances can occur, both in the cell under observation and in the cell before it in the series. These disturbances can cause harmful magnetic movements in the liquid aluminum or distortion of its surface, even though the rotating metal wave is absent.

According to a preferred version of the invention, therefore, the insulated divisions are provided with parallel bridging switches.

This bridge over the divisions in the anode beam has the result that, when there is a distorted distribution of cathodic current, the compensating currents in the anode support system in the next cell can flow not only through parts of the anode beam, but through the whole anode beam. Consequently any harmful effects in the form of magnetic movements or distortion of the metal surface are to a large extent eliminated.

The compensating currents are direct currents which are not identical to the alternating currents which cause the rotating metal wave.

Compared with the massive cross sections of the beams of the anode support system the conductive cross section of the switch is relatively small and amounts to 1–10% of that of the beam. The switches which have to bridge the insulated dividing regions in the anode support system are usefully mounted on the beam itself.

In modern pot rooms the switches are controlled automatically, in particular by means of electronic data processors, and opened and closed electromagnetically. In conventionally operated cells the bridges are normally closed so that the compensating currents can flow throughout the whole anode beam. If rotating metal waves form, the bridges are opened so that the parts of the anode beam between the electrically insulating separations are separated from each other. After the metal wave has been cut off, the bridges are closed over again.

The appearance of a fluctuation or distortion of the metal surface is detected by known methods namely by registering the current in the anode rods and, if an automatic system is used, an electronic data processor triggers off the switching system.

The present invention will be explained in detail with the aid of the following schematic drawings wherein FIG. 1 is a view of one version of the anodic part of an electrolytic cell.

DETAILED DESCRIPTION

Figure 1:
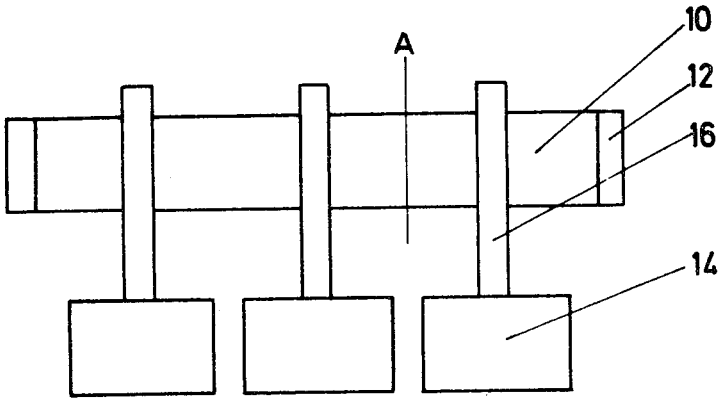

The anode support system with six anodes shown in FIGS. 1–4 are intended simply to illustrate the principle involved. In the electrolytic cells employed in industrial production of aluminum many more anodes are employed.

The anode support system comprises two parallel anode beams 10 with conductor plates 12 at the ends of these beams. Both the anode beams and the conductor plates are preferably made of aluminum. The end faces of the anode beams 10 are usefully welded to the conductor plates.

In the present example the busbars supplying current to the cell are connected to the conductor plates. These busbars, however, in particular in the case of large electrolytic cells can be connected not only to the end faces of the anode beams but on each part of the long sides of the beams which is advantageous for the operation of the cell. In this case an anode beam, depending on the arrangement of the beam, can also be separated into equal or unequal lengths and insulated at more than one place. Six anodes 14 are suspended from the anode beams 10 by anode rods 16 the upper parts of which are also made of aluminum.

In the case where current is supplied via the end faces of both anode beams a current $\alpha \cdot J$ is supplied to one end and $(1-\alpha) \cdot J$ from the other end. J represents the total current supplied to the cell and $\alpha$ is a constant distribution factor between 0 and 1 for a unit having many cells connected electrically in series. For FIGS. 1–3 it is assumed that the busbars connecting up to the next cell in the series are conceived such that $\frac{2}{3}$ of the direct current to the cell is fed to the anode beam from the left and $\frac{1}{3}$ from the right. The constant $\alpha$ is therefore equal to $\frac{2}{3}$. Each anode rod 16 leads to the anodes 14 and therefore feeds to the cell 1/6 of the total direct current.

If the anode beams 10 are now separated along the line A in FIGS. 1 and 2 and joined again with an electrically insulating, mechanically stable material 11 then all the anodes can still be supplied with the same current as before.

Figure 2:
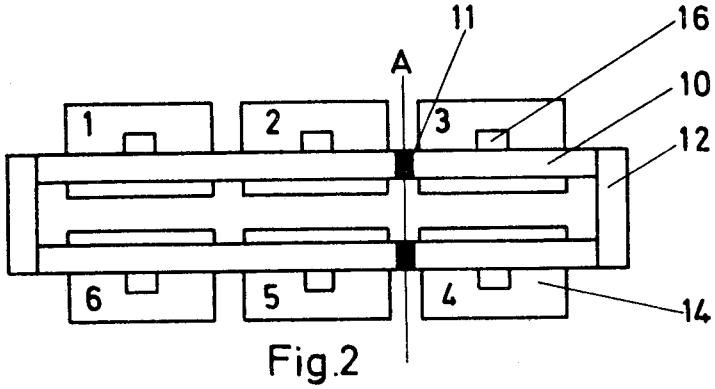
FIGS. 2–4 are plan views of the anodic part in FIG. 1 with dividers at different places.

Without the separation at the line A the alternating current due to a metal wave could form and flow between any diametrically opposite anodes in the cell i.e. anodes 1 and 4, 2 and 5, 3 and 6 (FIG. 2). By separating the beams at line A the circuit for the alternating current is broken for anodes 1 and 4, and 3 and 6. The unbroken circuit for anodes 2 and 5 is not sufficient to maintain a rotating metal wave, as this would find no driving, alternating current when it came to the corners.

Figure 3:
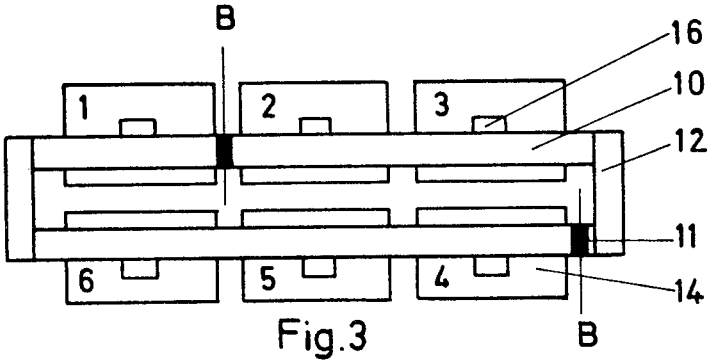

In FIG. 3 the separation is made at line B. A value of $\frac{2}{3}$ is taken again for the constant $\alpha$ and again $\frac{2}{3}$ of the direct current to the cell is fed from the left and $\frac{1}{3}$ from the right. It can also be seen that all the anodes can be supplied with their usual, nominal current. Anodes 1 and 4–6 are supplied from the left and anodes 2 and 3 from the right. The above defined circuit of the alternating current is broken for the anode pairs 2,5 and 3,6, while the circuit for the anodes 1,4 is unbroken.

Figure 4:
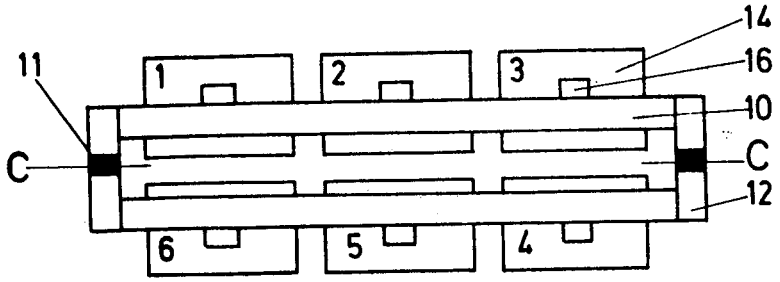

If an anode beam system is provided with an uneven number of anodes per beam, as is the case in FIG. 4, the distribution factor $\alpha$ equals 0.5 that is an equal amount of current is fed from left and right, the separation C must be made in the conductor plate 12 and not in the beams 10. Otherwise, it would not be possible to supply all anodes with their normal current. When an equal number of anodes are provided per beam the separation can of course also be at position C.

Figure 5:
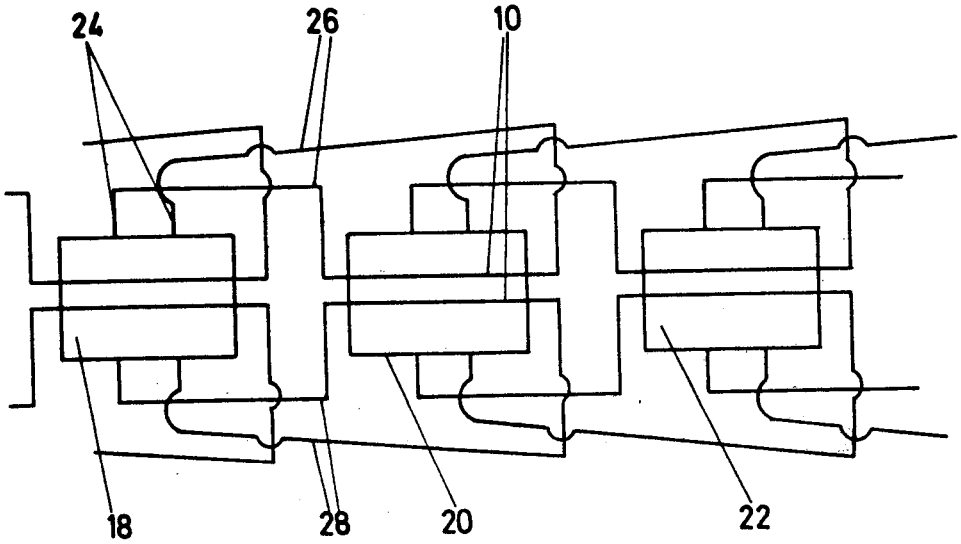
FIG. 5 is an arrangement of the busbars on three electrolytic cells connected in series.

In FIG. 5 three electrolytic cells 18, 20 and 22 are shown in series. Each cell has four cathode bars 24 which conduct the direct current from the cells to the next cell via busbars 26, 28, and do so with a constant $\alpha=0.5$ that is equal amounts of current are fed to the left and to the right of the anode beam. Also, with the division of the conductor plate 12, as in FIG. 4, all anodes can be supplied with their normal level of current. The diametrically opposite anodes have, however, apart from via the previous and subsequent cell in the series, no electrical connection. Consequently, the above mentioned alternating current circuit is interrupted, and therefore the metal wave cannot be maintained.

When the number of anodes is large, a complete separation and electrically insulating reconnection of the anode beam is made preferably as near as possible to the center of the electrolytic cell. The nearer the separation is to the center of the cell, the more alternating current circuits between diametrically opposite anode pairs can be interrupted, whereby, however, $\alpha$ i.e. the beam arrangement must be designed accordingly. Also, when the number of anodes is large, division of the conductor plate (FIG. 4) is particularly advantageous, partly because it depends on the beam arrangement and therefore $\alpha$.

The electrically insulating connecting pieces 11 in FIGS. 2–4 connect the anode beams 10 or the conductor plates 12 at the dividing lines A, B or C in a manner that provides mechanical stability in the system. These can be made of an insulating material which is used in electrical engineering, preferably wood or asbestos. The insulating dividers A, B and C are preferably bridged in parallel by switches not shown here.

If the anode support system is in one piece e.g. in the form of an extruded section, then the alternating current circuit involving anodes lying diametrically opposite each other can be interrupted only when the section, as shown in FIGS. 1 and 2, is completely separated at least in one place and joined again with electrically insulating material to form a mechanically stable joint.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An anode support system for supplying direct current to a molten salt electrolytic cell wherein a fraction of the total current supplied is fed to each end of the anode support system comprising at least two horizontal anode beams for supporting a plurality of anodes, at least two conductor plates for joining the ends of said at least two horizontal anode beams and at least two insulated joints provided at a location in said anode support system such that said anodes draw their normal current from the fraction supplied to each end of the anode support system whereby the metal wave in the cell is reduced without increasing the interpolar distance between the metal wave and the above lying anode.

2. An anode support system according to claim 1 wherein said insulated joints are provided in said conductor plates.

3. An anode support system according to claim 1 wherein said insulated joints are provided in said horizontal anode beams.

4. An anode support system according to claim 1 wherein said insulated joints are made from a material selected from the group consisting of wood and asbestos.

5. An anode support system according to claim 1 wherein said insulated joints are bridged together in parallel by switches.

6. An anode support system for supplying direct current to a molten salt electrolytic cell wherein a fraction of the total current supplied is fed to each end of the anode support system comprising a one piece anode beam for supporting a plurality of anodes and at least one insulated joint provided in said one piece anode beam at a location such that said anodes draw their normal current from the fraction supplied to each end of the anode support system whereby the metal wave in the cell is reduced without increasing the interpolar distance between the metal wave and the above lying anode.

7. An anode support system according to claim 6 wherein said insulated joints are made from a material selected from the group consisting of wood and asbestos.

8. An anode support system according to claim 6 wherein said insulated joints are bridged together in parallel by switches.

* * * * *